US007766307B2

(12) United States Patent
Urciuoli

(10) Patent No.: US 7,766,307 B2
(45) Date of Patent: Aug. 3, 2010

(54) CABLE HANDLING DEVICE

(75) Inventor: Joseph Charles Urciuoli, North Easton, MA (US)

(73) Assignee: MacTaggart, Scott (Holdings) Limited (GB)

( * ) Notice: Subject to any disclaimer, the term of this patent is extended or adjusted under 35 U.S.C. 154(b) by 0 days.

(21) Appl. No.: 12/048,276

(22) Filed: Mar. 14, 2008

(65) Prior Publication Data

US 2008/0224111 A1 Sep. 18, 2008

Related U.S. Application Data

(60) Provisional application No. 60/895,206, filed on Mar. 16, 2007.

(51) Int. Cl.
*B66D 1/30* (2006.01)

(52) U.S. Cl. ..... 254/374; 254/278

(58) Field of Classification Search ..... 254/278, 254/286, 294, 338, 371, 374, 393, 394
See application file for complete search history.

(56) References Cited

U.S. PATENT DOCUMENTS 2,017,149 A * 10/1935 Greening ..... 474/170
3,279,762 A * 10/1966 Bruns ..... 254/266
3,934,482 A * 1/1976 Byers ..... 474/9
4,030,569 A * 6/1977 Berkovitz ..... 187/254
4,417,718 A * 11/1983 Niskin ..... 254/394
4,441,692 A * 4/1984 Kovaleski ..... 254/390
4,657,202 A * 4/1987 Sauber ..... 242/577.1
4,936,549 A * 6/1990 Ivanov et al. ..... 254/264
5,217,176 A * 6/1993 Hall ..... 242/364
5,792,294 A * 8/1998 Randazzo et al. ..... 156/94
6,041,476 A * 3/2000 deNormand ..... 16/197
6,386,324 B1 * 5/2002 Baranda et al. ..... 187/254
6,386,516 B1 * 5/2002 Lenders ..... 254/393
6,390,242 B1 * 5/2002 Baranda et al. ..... 187/254
6,401,871 B2 * 6/2002 Baranda et al. ..... 187/254
6,540,068 B1 * 4/2003 Wesson et al. ..... 198/843
7,175,163 B2 * 2/2007 Blanc ..... 254/278

* cited by examiner

*Primary Examiner*—Emmanuel M Marcelo
(74) *Attorney, Agent, or Firm*—Stephen M. Nipper; Dykas, Shaver & Nipper, LLP

(57) ABSTRACT

A cable handling device for use in the deployment and/or retrieval of a cable comprises a drum which provides mounting for a number of grooved rings, the rings receiving a cable thereabout. The drum forms an inner bearing race with each ring forming an outer bearing race such that the rings are independently and rotatably coupled to the drum. A second drum having one or more grooved ring is provided and the cable can be wound around the first and second drums. In use, one or both of the drums is rotated and the device is adapted to control the tension in the cable and/or to mitigate distortion in the cable caused by slippage between the cable and the device.

19 Claims, 3 Drawing Sheets

CABLE HANDLING DEVICE

CROSS-REFERENCE TO RELATED APPLICATIONS

This application claims the priority date of the provisional application entitled CABLE HANDLING DEVICE, filed on Mar. 16, 2007, with application Ser. No. 60/895,206, the disclosure of which is incorporated herein.

FIELD OF THE INVENTION

The present invention relates to a cable handling device, and in particular, but not exclusively, to a capstan for use in a sea-going vessel.

BACKGROUND TO THE INVENTION

Sea-going vessels such as ships, submarines or the like may be required to deploy and retrieve cables including, for example, but not exclusively, towed arrays, sonar equipment or the like. Deployment or retrieval of such cables may be facilitated by use of a capstan or similar device.

Referring to FIG. 1 of the drawings, a single drum capstan arrangement is shown, the capstan comprising a single capstan drum or spindle 10 around which a cable or rope 12 may be wrapped or wound. An alternative arrangement (not shown) provides a double drum capstan comprising two multi-groove drums, one drum having one less groove than the other. In use, a cable is adapted to be wound alternately around the first and second drums.

A capstan, whether comprising a single or double drum, may be utilised as a means of achieving a mechanical advantage in the addition or reduction of tension during deployment or retrieval of the cable. It will be recognised that the amount of tension that may be removed or added by wrapping around a capstan is a function of: the initial tension ($T_1$); the co-efficient of friction ($\mu$) between the capstan and the cable; and the angle of contact ($\beta$ radians) between the capstan and the cable. Thus, the tension may be ascertained from the capstan equation, $T_2=T_1e^{\mu\beta}$.

For example, in the capstan arrangement shown schematically in FIG. 1, where the co-efficient of friction ($\mu$) between the cable and capstan drum is 0.10, the tension ratio (T2\T1) of a single groove is approximately 1.369 for an angle of contact of approximately 180 degrees (3.14 radians). This is based on the assumption of infinite rigidity of the drum and cable. However, in reality, whereas drums tend to be relatively rigid, cables, ropes and, in particular, sensor arrays may not be.

It will be recognised that, when a capstan is engaged in retrieving a cable experiencing hydrodynamic drag, as the cable progresses from one groove to the next groove, the tension in the cable reduces. Thus, the cable will contract and its linear velocity will reduce. However, the surface velocity of the drum will remain constant. It is evident that where a difference in velocity is present, distortion between the capstan drum and the cable may arise. Therefore, relative elasticity between the drum and the cable may introduce relative velocities, or slippage, this slippage between the cable and drum resulting in frictional stresses which can be damaging to the cable.

Cable damage is of particular concern where it relates to an expensive and sophisticated cable such as a submarine or surface ship acoustic array and the distortion and/or damage to the cable caused by the relative velocity, or slippage, may result in the operational effectiveness of the vessel being compromised.

SUMMARY OF INVENTION

According to a first aspect of the present invention, there is provided a cable handling device for use in the deployment or retrieval of a cable, the device comprising: a first driven member; a plurality of bearing members for receiving a cable thereabout, the bearing members being independently and rotatably coupled to the first driven member.

At least one of the bearing members may be adapted to slip relative to the first driven member. It will be recognised that slippage occurs, for example, where there is a relative velocity between the first driven member and the bearing member. Advantageously, relative velocity or slippage occurs between the first driven member and the bearing members as opposed to slippage between the cable and the bearing members.

A device according to embodiments of the present invention may be adapted to control the tension in a cable and/or to mitigate distortion in the cable caused by relative angular velocity or slippage between the device, for example, but not exclusively a capstan, and a cable or the like. Thus, frictional stresses between the device and the cable may be maintained within predetermined, and reduced, limits. The device may be utilised in the tensioning or de-tensioning of a cable wrapped or wound about the device, for example, but not exclusively, in the deployment or retrieval of a cable from a sea-going vessel, such as a submarine or the like.

It will be understood that the term cable applies to any elongate member, for example, but not exclusively, a cable, rope, wire, conduit or the like. In one embodiment of the present invention, the device is adapted for use in the deployment or retrieval of a cable array, such as may be utilised in a sea-going or submarine vessel's sensor array.

The bearing members may be configured for independent rotation with respect to each other. Each bearing member may be adapted to rotate at a different angular velocity relative to the first driven member and to at least one other bearing member, as required. Thus, each bearing member may slip relative to the first driven member independently. Advantageously, and as noted above, slippage may preferentially occur between the first driven member and each bearing member as opposed to slippage occurring between the respective bearing member and the cable.

Thus, tensioning or de-tensioning of the cable may be controlled in a quantifiable manner in which one or all of the bearing members may be employed or recruited to contribute to the tensioning or de-tensioning of the cable, where appropriate.

The bearing members may comprise discs or rings mounted around the first driven member. The bearing members and first driven member together may form or provide mounting for a bearing, for example, but not exclusively, a plain bearing, journal bearing or the like. The bearing members may be of different or varying diameters.

The bearing members may further comprise grooves or slots around their periphery for receiving at least a portion of the cable. Accordingly, the cable may be wound around the device such that a portion of the cable is received within the groove of the bearing member.

The first driven member may further comprise or provide mounting for a clutch plate or friction surface between the first driven member and each bearing member. Alternatively, or in addition, at least one of the bearing members may define or provide mounting for a clutch plate or friction surface. Accordingly, the degree of slippage occurring between the first driven member and the bearing members may be controlled within acceptable levels, each bearing member adapted to slip relative to the first driven member with each ring effectively finding the appropriate angular velocity for the relevant section of cable.

It will be recognised that the tensioning and de-tensioning ratio increases progressively according to the capstan equation for each driven ring. It will be further recognised that the maximum tensioning or de-tensioning ratio that can be provided by a 180° turn on a single ring is a function of the bearing friction value and the ratio of the radius ratio of the groove and bearing. Thus, by appropriate design of the bearing, through selection of the frictional co-efficient and radius ratio between the bearing and ring, the tension ratio can be set to a safe level where the risk of damage to the cable is minimised.

The device may further comprise a rotary drive. The rotary drive may comprise a motor, for example, but not exclusively, an electric motor, hydraulic motor or other suitable rotary drive.

The first driven member may comprise a drum, shaft, axle or the like. The first driven member may be integral to, or alternatively may be coupled to, the rotary drive.

In one embodiment, the device may further comprise a second driven member. The second driven member may comprise a drum, shaft, axle or the like.

The second driven member may provide support for at least one bearing member. The bearing members may comprise grooved rings, each groove adapted to receive a section of cable.

The second driven member may be rotatably coupled to the first driven member.

The second driven member may be synchronously rotatably coupled to the first driven member, for example, but not exclusively, through a chain, belt, gearing arrangement or the like.

Alternatively, the second driven member may be driven independently by a second rotary drive means. Alternatively, the second driven member may be idle with respect to the first driven member.

In one embodiment, the axis of rotation of the first driven member may be angled such that the cable is aligned with the corresponding next groove of the second driven member.

The device may further comprise a frame rotatably coupled to the first driven member, the frame adapted to support the first driven member. The first driven member may be adapted to rotate with respect to the frame. Where a second driven member is provided, the frame may also be adapted to support the second driven member.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
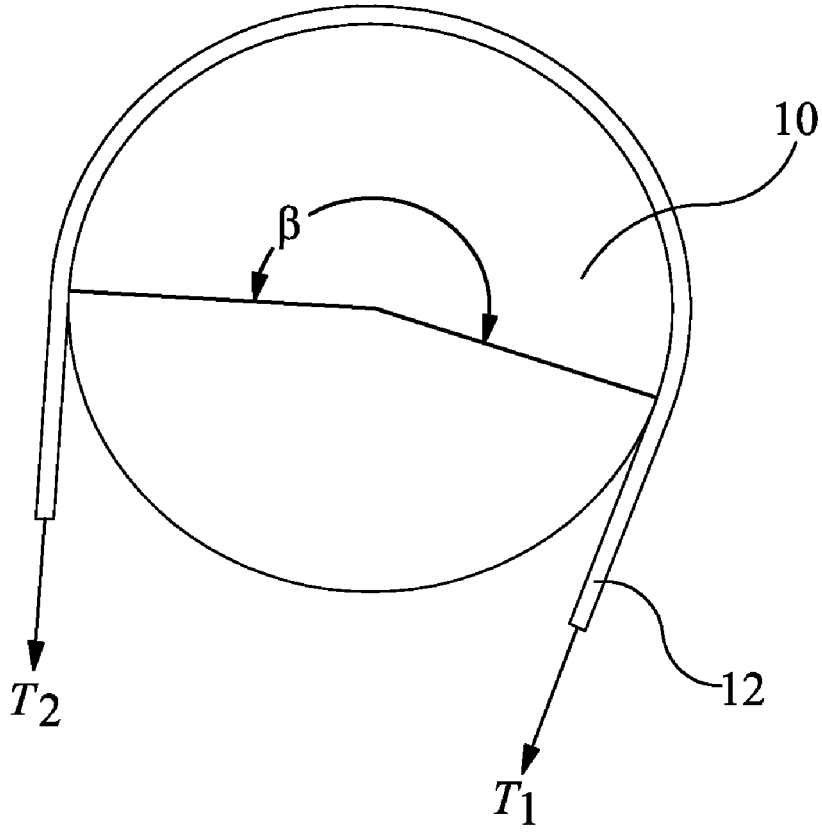
FIG. 1 is a schematic view of a single drum capstan.
Figure 2:
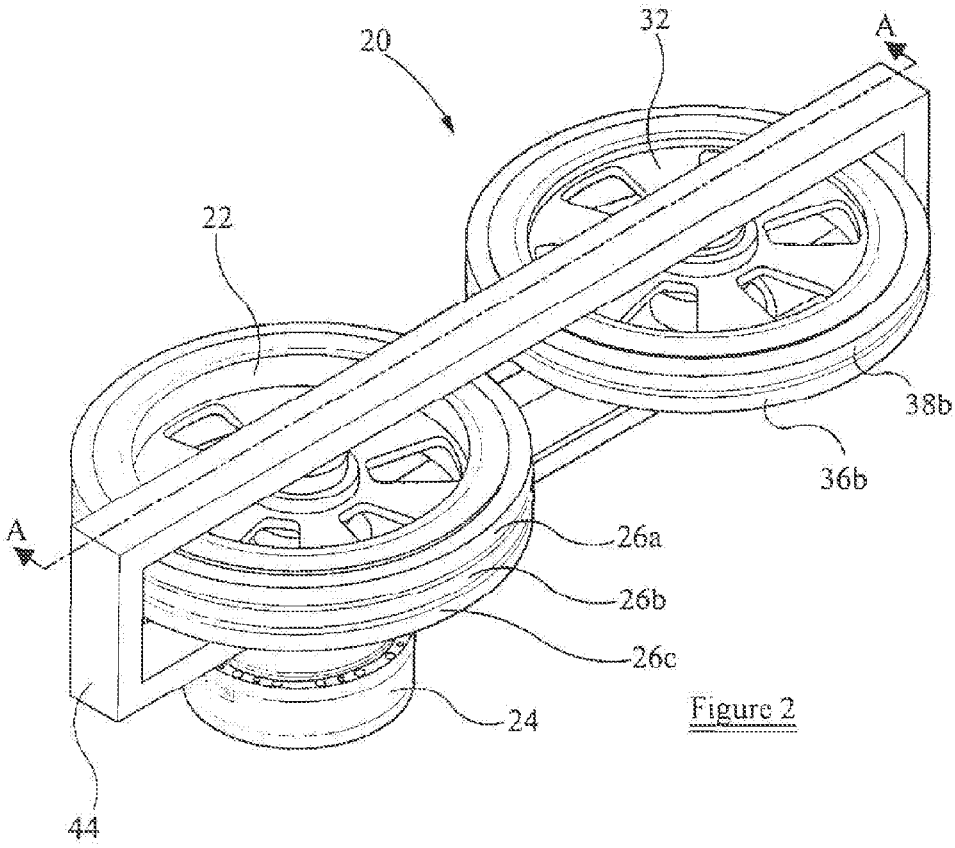
FIG. 2 is a perspective view of a cable device according to an aspect of the present invention.
Figure 3:
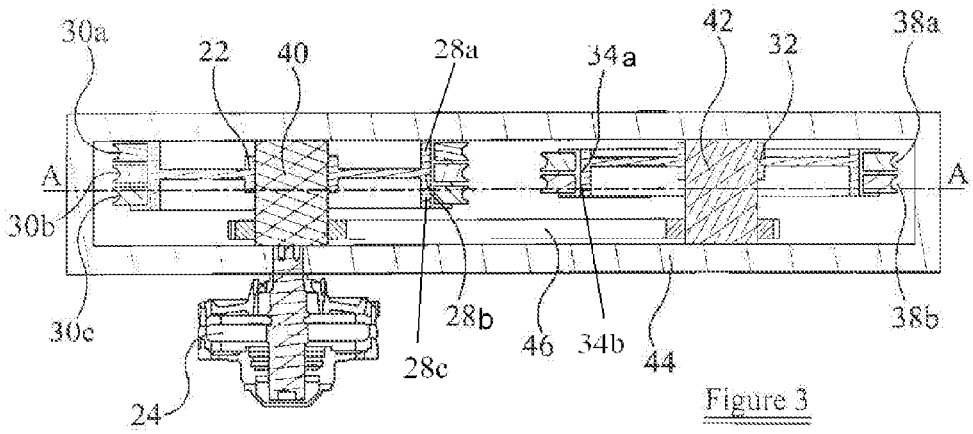
FIG. 3 is a sectional view of the cable device of FIG. 1.
Figure 4:
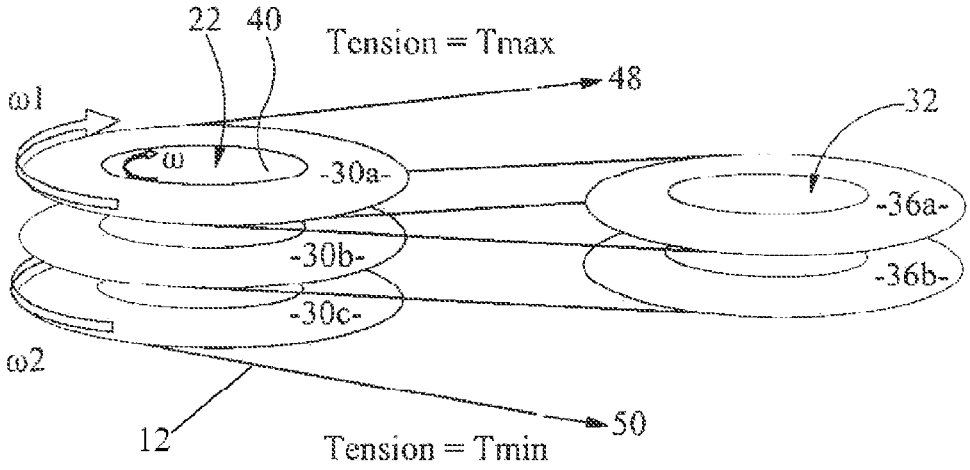
FIG. 4 is a schematic view of the cable device of FIGS. 1 and 2 during deployment of a cable.
Figure 5:
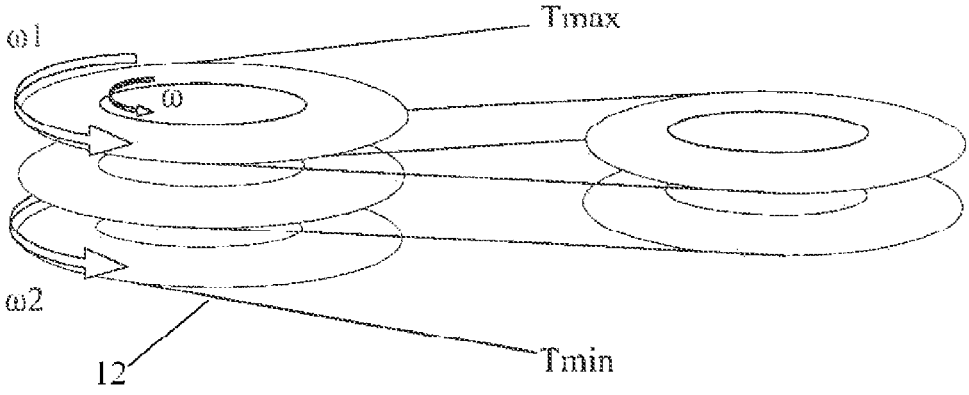
FIG. 5 is a schematic view of the cable device of FIGS. 1 to 3 during retrieval of a cable.

In reference initially to FIGS. 2 and 3 of the drawings, there is shown a perspective view of a cable handling device 20 in accordance with an embodiment of the present invention, the device 20 for use in the deployment or retrieval of a cable 12 (as shown in FIG. 4 or 5). The device 20 comprises a first drum 22 rotatably coupled to a drive motor 24, the drum 22 comprising the inner races of journal bearings 28*a*, 28*b* and 28*c*. As shown, the bearing races 28*a*, 28*b* and 28*c* are of the same diameter. However, it will be recognised that the bearing races 28*a*, 28*b* and 28*c* may be of varying diameters in order to achieve additional variations in the tensioning and de-tensioning capability of the device 20.

As shown in FIG. 2, three discs or rings 26*a*, 26*b* and 26*c* are coupled around the first drum 22, the rings 26*a*, 26*b* and 26*c* comprising the outer races of the journal bearings 28*a*, 28*b* and 28*c* (shown most clearly in FIG. 3). Although the rings 26*a*, 26*b* and 26*c* are shown as being of substantially equal diameter, the rings 26*a*, 26*b* and 26*c* may be different or varying diameter. Each ring 26*a*, 26*b*, 26*c* comprises a groove 30*a*, 30*b*, 30*c* extending around the circumference of the ring 26*a*, 26*b*, 26*c* and the grooves 30*a*, 30*b*, 30*c* are adapted to receive a section of cable 12 (as shown in FIGS. 4 and 5).

The device 20 further comprises a second drum 32 of similar construction to the first drum 22. The second drum 32 thus comprises the inner races of journal bearings 34*a* and 34*b*. It will again be recognised that the bearing races 34*a*, 34*b* may be of different or varying diameters in order to achieve additional variations in the tensioning and de-tensioning capability of the device 20. Two rings 36*a* and 36*b* rotationally mounted around the second drum 32 comprise the outer races of the bearings 34*a* and 34*b*. The rings 36*a*, 36*b* also comprise grooves 38*a*, 38*b* extending around the circumference of the rings 36*a*, 36*b*.

Each drum 22, 32 comprises a central hub or shaft portion 40, 42, the shafts 40, 42 mounted for rotation within a support frame 44.

The device 20 further comprises a synchronising drive in the form of a chain drive 46 (shown most clearly in FIG. 3) coupled between the first shaft 40 and the second shaft 42 and, in use, it will be recognised that rotation of the first shaft 40 by the motor 24 will result in synchronous rotation of the second shaft 42 via the chain 46.

Operation of the device 20 will now be described with reference to FIGS. 2 to 5 of the drawings. The cable 12 is wound around the grooves 30*a*, 30*b*, 30*c*, 38*a*, 38*b* of the first and second drums 22, 32 in accordance with the sequence 30*a*, 38*a*, 30*b*, 38*b*, 30*c*, the cable 12 being retained by frictional engagement with the grooves 30*a*, 30*b*, 30*c* 38*a* and 38*b*.

In reference particularly to FIG. 4 of the drawings, which schematically represents operation of the device 20 during deployment of the cable 12, the maximum tension in the cable 12 is maintained by an external force as shown by arrow 48, typically, hydrodynamic drag. The minimum tension in the cable 12 is maintained by a second external force as shown by arrow 50, this force exerted by a storage winch (not shown) typically used to store the cable 12.

During deployment of the cable 12, the drive motor 24 (as shown in FIGS. 2 and 3) is operated to rotate the first shaft 40 at a first angular velocity of $\omega$ radians per second. As the cable 12 is deploying, a retarding torque acts to oppose the direction of rotation. Thus, the cable 12 will tend to slip forward relative to the drum 22. It will be recognised that, as the rings 26*a*, 26*b* and 26*c*; and 36*a* and 36*b* are independently rotatable with respect to their respective drum 22, 32, the first ring 26*a* has an angular velocity of $\omega_1$ radians per second, where $\omega_1$ is greater than the shaft speed $\omega$.

As the cable 12 around ring 26*a* is under higher tension than the other rings, slippage will be initiated at this ring 26*a* with rings 36*a*, 26*b*, 36*b* and 26*c* being recruited in sequence until the required de-tensioning ratio is achieved. Thus, the angular velocity $\omega_2$ of final ring 26*c* is less than the angular velocity $\omega_1$ of first ring 26*a*. Furthermore, the angular velocity $\omega_2$ of final ring 26*c* is less than or equal to the angular velocity of the first shaft 40.

It will be understood that slippage occurs preferentially between the rings 26*a*, 26*b*, 26*c*, 36*a*, 36*b* and the respective drum 22, 32 rather than between the cable 12 and the grooves 30*a*, 30*b*, 30*c* 38*a* and 38*b*. This is the case, for example, where the following condition is met:

$$\mu_{bearing} < k \cdot \frac{R_{groove}}{R_{bearing}} \cdot \mu_{groove},$$

where $\mu_{bearing}$ is the coefficient of friction in the bearing; $\mu_{groove}$ is the coefficient of friction in the groove; $R_{groove}$ is the radius of the groove; $R_{bearing}$ is the radius of bearing; and k is a factor that accounts for the pressure distribution between the cable and groove being different to the pressure distribution in the bearing.

As discussed hereinabove, the maximum de-tensioning ratio that can be provided by a 180 degree turn on a single groove can be shown to be a function of the bearing friction value and the ratio of the radius ratio of the groove and bearing. This can be expressed by the following:

$$\frac{T_2}{T_1} = \frac{1 + \mu_{bearing} \cdot \frac{R_{bearing}}{R_{groove}}}{1 - \mu_{bearing} \cdot \frac{R_{bearing}}{R_{groove}}}$$

or, where an 'equivalent coefficient of friction ($\mu_{equiv}$) is defined, $$\frac{T_2}{T_1} = \frac{1 + \mu_{equiv}}{1 - \mu_{equiv}}, \text{ where } \mu_{equiv} = \mu_{bearing} \cdot \frac{R_{bearing}}{R_{groove}}$$

Though not wishing to be bound by theory, it will be recognised that, through selection of the frictional coefficient and the ratio of the bearing and groove radii, the tension ratio may be controlled within a pre-selected level such that the risk of damage to the cable may be substantially eliminated or mitigated.

In reference now to FIG. 5 of the drawings, which schematically represents operation of the device 20 during retrieval of the cable 12, the drums 22, 32 are rotated in the opposite direction (as shown by the arrows in FIG. 5) to that for deployment of the cable 12 and at an angular velocity of $\omega$ radians per second. Thus, the forces are reversed such that slippage will be initiated at ring 26*c* with rings 36*b*, 26*b*, 36*a* and 26*a* being recruited in sequence until the required tensioning ratio is achieved.

Accordingly, by the provision of independently rotatable rings 26*a*, 26*b*, 26*c*, 36*a*, and 36*b*, the present invention may be utilised to set a predetermined, and reduced, limit to the frictional stress between the device 20 and the cable 12 such that the negative effects of distortion and/or slippage of the cable relative to the device 20 may be mitigated or substantially minimised.

Those of skill in the art will further recognise that the illustrated device is merely exemplary of the present invention, and that the same objectives may be achieved by using a variety of different configurations.

The invention claimed is:

1. A cable handling device for use in the deployment or retrieval of a cable, the device comprising:

a first driven member coupled to a rotary drive;

a plurality of bearing members independently and rotatably coupled to the first driven member and configured to receive a cable thereabout;

a second driven member; and, at least one bearing member independently and rotatably coupled to the second driven member and configured to receive the cable thereabout, wherein the rotary drive rotates the first and the second driven members.

2. The cable handling device of claim 1, wherein at least one of the bearing members is adapted to slip relative to the driven member to which it is coupled.

3. The cable handling device of claim 2, wherein the at least one bearing member is adapted to slip at a tension ratio lower than a tension ratio possible for slippage between the cable and the bearing member.

4. The cable handling device of claim 2, wherein a plurality of the bearing members are adapted to slip and the device is configured so that there is a progression of slippage between the bearing members and the driven members during deployment and retrieval of the cable.

5. The cable handling device of claim 4, wherein the device is configured so that the bearing member encountering the highest tension slips first and the slippage progresses to lower tension bearing members during deployment.

6. The cable handling device of claim 5, wherein the bearing member encountering the highest tension and the bearing member encountering the lowest tension are coupled to the first driven member.

7. The cable handling device of claim 4, wherein the device is configured so that the bearing member encountering the lowest tension slips first and the slippage progresses to higher tension bearing members during retrieval.

8. The cable handling device of claim 4, wherein the device is configured so that at a maximum design tension there is substantially no slippage of the bearing member encountering the lowest tension during deployment and so that there is substantially no slippage of the bearing member encountering the highest tension during retrieval.

9. The cable handling device of claim 1, wherein at least one of the bearing members is configured for independent rotation with respect to at least one other bearing member.

10. The cable handling device of claim 1, wherein the bearing members comprise grooved rings mounted around the first and second driven members.

11. The cable handling device of claim 10, wherein the axis of rotation of the first driven member is angled such that the cable is aligned with the corresponding next groove of the second driven member.

12. The cable handling device of claim 1, wherein at least two of the bearing members are of the same diameter.

13. The cable handling device of claim 1, wherein at least one of: the first driven member; the second driven member; and at least one of the bearing members further comprises or provides mounting for a clutch plate or friction surface.

14. The cable handling device of claim 1, wherein the first driven member and the second driven member are selected from one of, or a combination of, a drum, a shaft, and an axle.

15. The cable handling device of claim 1, wherein the first driven member is integral to the rotary drive.

16. The cable handling device of claim 1, wherein the second driven member is adapted to be coupled to the first driven member.

17. The cable handling device of claim 16, wherein the second driven member is adapted to be synchronously rotatably coupled to the first driven member.

18. The cable handling device of claim 1, wherein the second driven member is rotated by rotation of the first driven member via at least one of: a chain; a belt; and a gearing arrangement.

19. The cable handling device of claim 1, wherein the cable comprises at least one of: an elongate member; a rope; a wire; a conduit; an array; and a sensor array.

* * * * *